US012404574B2

(12) United States Patent
Tsuge et al.

(10) Patent No.: US 12,404,574 B2
(45) Date of Patent: Sep. 2, 2025

(54) ALLOY MATERIAL AND METHOD FOR PRODUCING SAME

(71) Applicant: NIPPON STEEL STAINLESS STEEL CORPORATION, Tokyo (JP)

(72) Inventors: Shinji Tsuge, Tokyo (JP); Masatomo Kawa, Tokyo (JP); Yukio Nakamura, Tokyo (JP); Kenichiro Kusunoki, Tokyo (JP); Yukihiro Nishida, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 516 days.

(21) Appl. No.: 17/918,337

(22) PCT Filed: Apr. 26, 2021

(86) PCT No.: PCT/JP2021/016573
§ 371 (c)(1),
(2) Date: Oct. 12, 2022

(87) PCT Pub. No.: WO2021/221003
PCT Pub. Date: Nov. 4, 2021

(65) Prior Publication Data

US 2023/0143965 A1 May 11, 2023

(30) Foreign Application Priority Data

Apr. 28, 2020 (JP) ..... 2020-079036

(51) Int. Cl.
*C21D 1/26* (2006.01)
*C21D 1/02* (2006.01)
(Continued)

(52) U.S. Cl.
CPC ..... *C22C 38/60* (2013.01); *C21D 1/02* (2013.01); *C21D 1/26* (2013.01); *C21D 6/004* (2013.01);
(Continued)

(58) Field of Classification Search
CPC ..... C21D 1/26
See application file for complete search history.

(56) References Cited

U.S. PATENT DOCUMENTS

2001/0045246 A1* 11/2001 Baudry ..... C22C 38/08 148/336
2017/0096727 A1* 4/2017 Reydet ..... C22C 38/04

FOREIGN PATENT DOCUMENTS

JP 04-72037 3/1992
JP 07-102345 4/1995
(Continued)

OTHER PUBLICATIONS

English machine translation of JP H10-60528 A of Tsuge (Year: 1998).*
(Continued)

*Primary Examiner* — Jophy S. Koshy
(74) *Attorney, Agent, or Firm* — Birch, Stewart, Kolasch & Birch, LLP

(57) ABSTRACT

An alloy material is provided which contains elements including, in mass %, C: 0.010 to 0.10%, Si: more than 0.10% to 0.50% or less, Mn: 0.05 to 0.50%, Ni: 34.5 to 37.0%, and Nb: 0.001 to 1.0%, and which satisfies [$T_0 \leq T_1$-2], [C—Nb/7.7-Ta/15≤0.045], [Nb-7.7C≤0.30], and [Ta-15C≤0.30]. Where, each symbol of an element in the above formulas represents a content (mass %) of the corresponding element, $T_0$ represents a Curie temperature (° C.) of the alloy material, and $T_1$ represents a Curie temperature (° C.) of the alloy material after the alloy material is held at 900° C. for
(Continued)

one minute and thereafter is cooled under conditions such that an average cooling rate in a temperature range from 600 to 300° C. is 0.2° C./s.

5 Claims, 1 Drawing Sheet

(51) Int. Cl.

| | |
|---|---|
| ***C21D 6/00*** | (2006.01) |
| ***C21D 8/02*** | (2006.01) |
| ***C22C 38/60*** | (2006.01) |
| *C21D 1/60* | (2006.01) |
| *C21D 9/46* | (2006.01) |
| *C22C 38/00* | (2006.01) |
| *C22C 38/02* | (2006.01) |
| *C22C 38/04* | (2006.01) |
| *C22C 38/42* | (2006.01) |
| *C22C 38/44* | (2006.01) |
| *C22C 38/46* | (2006.01) |
| *C22C 38/48* | (2006.01) |
| *C22C 38/52* | (2006.01) |
| *C22C 38/54* | (2006.01) |

(52) U.S. Cl.
CPC ..... *C21D 8/0205* (2013.01); *C21D 1/60* (2013.01); *C21D 8/0242* (2013.01); *C21D 8/0247* (2013.01); *C21D 9/46* (2013.01); *C22C 38/002* (2013.01); *C22C 38/005* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *C22C 38/52* (2013.01); *C22C 38/54* (2013.01)

(56) References Cited

FOREIGN PATENT DOCUMENTS

| | | |
|---|---|---|
| JP | 10-17997 | 1/1998 |
| JP | 10-60528 | 3/1998 |
| JP | 2003-027188 | 1/2003 |

OTHER PUBLICATIONS

Susumu Hongoh et al., "Development of LNG Piping using Invar Alloy (report 3), Multi-pass GTAW process for thick joint of FE-36% Ni alloy", JHPI, vol. 41, No. 4, 2003.

* cited by examiner

ALLOY MATERIAL AND METHOD FOR PRODUCING SAME

TECHNICAL FIELD

The present invention relates to an alloy material and a method for producing the alloy material.

BACKGROUND ART

Low-expansion alloys are characterized by the coefficient of thermal expansion thereof being remarkably small, with the coefficient of thermal expansion being one-tenth or less that of iron or nickel. Low-expansion alloys include Invar alloys, Super Invar alloys, stainless Invar alloys, Fe—Pd alloys and the like, and a representative alloy among these is Fe—Ni Invar alloys that contain about 36% by mass of Ni in Fe. Hereunder, the Fe—Ni Invar alloy may be abbreviated and referred to as "Invar alloy".

The low expansion characteristics of these alloys are attributable to volume shrinkage that is caused by temperature drop and volume expansion that is caused by spontaneous volume magnetostriction offsetting each other. For example, it is known that an Invar alloy exhibits a small expansion characteristic at the Curie point or less, which is in the vicinity of 200 to 300° C., and the expansion coefficient rapidly increases immediately above the Curie point.

The applications of low-expansion alloys include uses such as for standard scales, measurement instruments, glass sealing materials, shadow masks, frame alloys for ICs, dies, and structures in cryogenic environments. As specific applications with respect to cryogenic structures, in the case of Invar alloys, liquefied natural gas (LNG) storage containers and pipes and the like can be mentioned.

When applying an Invar alloy to a cryogenic structure, the Invar alloy is welded and used. Since the weld crack sensitivity of a thick-walled Invar alloy material is high, it is necessary to suppress solidification cracking and reheat cracking of the weld metal. Therefore, in some cases welding is performed using a special welding material containing a high concentration of C and Nb.

For example, Non-Patent Document 1 discloses a technique that, when welding an Invar alloy plate having a plate thickness of 9.5 mm for use for LNG piping, uses two kinds of welding materials (wires) in which the contents of Nb are different, and obtains a weld zone without cracks while controlling the wire feeding speed and the weld heat input. According to such welding, the chemical composition of the weld metal can be adjusted to a desired range by controlling the mixing ratio (base metal dilution) between the base metal and a plurality of welding materials having different chemical compositions to within a certain range.

For example, as Patent Documents 1 to 5 disclose, conventionally, efforts have been made to adjust the chemical composition of the base metal itself of Invar alloy materials for the purpose of improving hot workability, strength, the elastic constant, and low thermal expansion characteristics.

LIST OF PRIOR ART DOCUMENTS

Patent Document

Patent Document 1: JP7-102345A
Patent Document 2: JP4-72037A
Patent Document 3: JP10-17997A
Patent Document 4: JP10-60528A
Patent Document 5: JP2003-27188A

Non Patent Document

Non-Patent Document 1: Hongoh S. et al., Development of LNG Piping using Invar Alloy (Report 3), Multi-pass GTAW process for thick joint of Fe-36% Ni alloy, Pressure Engineering Vol. 41, No. 4, pp. 160-167, 2003, Publication of High Pressure Institute of Japan

SUMMARY OF INVENTION

Technical Problem

According to the welding technique described in Non-Patent Document 1, although a welded structure can be produced using a thick-walled Invar alloy as a base metal (hereinafter, simply referred to as "alloy material"), there is a problem that the degree of freedom with respect to welding workability is low. Further, Patent Documents 1 to 5 do not take into consideration the degree of freedom with respect to welding workability when producing a welded structure using a thick-walled alloy material.

Here, an alloy material is usually produced by hot rolling, and the alloy material after hot rolling may be air-cooled or, for example, in some cases may be water-cooled for the purpose of shortening the production time. That is, in the prior art, although performing cooling after hot rolling by water-cooling has been taken into consideration, consideration has not been given to under what conditions a thick-walled alloy material should be cooled in order to increase the degree of freedom with respect to welding workability.

An objective of the present invention is to provide, at a low cost, an alloy material that can increase the degree of freedom with respect to welding workability when producing a welded structure using the alloy material while maintaining low thermal expansion characteristics, and a method for producing the alloy material.

Solution to Problem

To solve the problem described above, the present inventors considered reducing the differences between the chemical compositions of an alloy material and a welding material, that is, increasing the contents of C and Nb in the base metal.

When the contents of C and Nb in an alloy material are increased, the hot workability deteriorates. Among the impurity elements that reduce the hot workability of an alloy material, S is the element which has the greatest influence. Therefore, in order to improve the hot workability, it is important to reduce the content of S, and also to sufficiently contain Mn that fixes and detoxifies S. That is, in the chemical composition of the alloy material, it is important to increase the contents of C and Nb, decrease the content of S, and contain an appropriate amount of Mn as an essential element.

On the other hand, when C and Nb are contained in a large amount, the coefficient of linear expansion of the alloy material increases. A compositional characteristic of the alloy material of the present invention is that the alloy material contains both of C and Nb. These elements form NbC (Nb carbide) in the alloy material. Further, at such time, since the coefficient of linear expansion increases with excess C ($\Delta C$) or excess Nb ($\Delta Nb$), the respective values of $\Delta C$ and $\Delta Nb$ are restricted to an upper limit value or less. Ta is an element that belongs to the same group as Nb in the periodic table, and in the present alloy material Ta may be added in lieu of a part of Nb, and hence for the same reason it is important to restrict an upper limit value of excess Ta (ΔTa).

Here, equations for ΔC, ΔNb, and ΔTa are expressly defined. Note that, if Ta is not included, 0 is substituted for the Ta term.

$$\Delta C = C - Nb/7.7 - Ta/15$$

$$\Delta Nb = Nb - 7.7C$$

$$\Delta Ta = Ta - 15C$$

On the other hand, in an alloy material that uses the Fe—Ni Invar alloy, most of the alloying elements other than Fe and Ni have an action that increases the coefficient of expansion. An action that increases the coefficient of expansion is different for each element. Therefore, it is necessary to select, melt and refine the raw materials so that the content of elements which get mixed in as impurities is reduced as much as possible. However, in the case of the industrial mass production of an alloy material, the usual equipment that is used for melting and refining stainless steel is used, and impurity elements attributable to stainless steel get mixed into the alloy material.

Among the principal components of stainless steel other than Fe and Ni, elements such as Cr, Mo, Cu, and Co become the main impurity elements in the Invar alloy, and hence it is necessary to ensure that the amount of these elements that is mixed in is small. For example, it is required to use high-purity ferro-alloys and alloys as raw materials for melting and refining Invar alloys, and to use newly constructed pots (containers for melting). All of such constraints with respect to the production method are reflected in an increase in the cost of producing the Invar alloy.

Therefore, the present inventors conducted studies regarding a production method which can achieve a low coefficient of thermal expansion in a thick-walled (plate thickness ranging from 3 mm to 80 mm) alloy material without increasing the production cost as described above. As a result, it has been revealed that in a cooling process of hot rolling or in a cooling process after a heat treatment, it is effective to perform cooling so that the average cooling rate in a temperature range from 600 to 300° C. is 2.0° C./s or more. The present inventors discovered that, by this means, the development of a magnetic phase that causes the coefficient of linear expansion to increase is suppressed, and low thermal expansion is realized.

Here, unless otherwise specified, the term "plate temperature" normally means the surface temperature. Therefore, normally, control of the cooling rate also controls changes in the plate temperature of an alloy material. For example, although in the case of a thin plate having a thickness of less than 3 mm, a difference in temperature history between the central part of the plate thickness and the surface is small, in the case of an alloy material that is a thick plate having a thickness that is 3 mm or more, or furthermore is 6 mm or more, it has been found that when temperature changes at the surface are controlled in the usual manner, sufficient performance cannot be secured.

Further, upon conducting studies regarding the temperature at the central part of the plate thickness, the present inventors found that in a thick-walled alloy material, there is a tendency for the cooling rate after hot rolling or a heat treatment in the production process of the thick-walled alloy material to decrease, and that a magnetic phase that increases the coefficient of linear expansion develops in the alloy material during the cooling process.

Although the aforementioned magnetic phase is a common ferromagnetic phase that appears in Fe—Ni alloys, it is a magnetic phase in which the atomic arrangement of Fe and Ni is changed in a slightly regularizing direction. The present inventors found that the extent of development of this magnetic phase caused by a difference in the cooling rate at the central part of the plate thickness can be ascertained by determining the Curie temperature: Tc under a specific magnetizing force, and that the coefficient of linear expansion can be maintained at a low value by controlling the cooling rate so that Tc is small.

Specifically, the present inventors found that in a cooling process of hot rolling or in a cooling process after a heat treatment, it is important to perform cooling in a manner so that in the temperature range of 600 to 300° C., the average cooling rate of the central part of the plate thickness of the alloy material is 2.0° C./s or more.

However, although it is possible to measure the temperature at the central part of the plate thickness with an experimental test specimen in a laboratory, it is not easy to measure the temperature at the central part of the plate thickness in the production process during actual operations. Therefore, the present inventors conducted repeated studies focusing on the water amount density in the cooling process, and as a result found that, when the plate thickness of an alloy material is represented by t (mm), by ejecting cooling water at a temperature of 35° C. or less onto the aforementioned alloy material so that the water amount density ($m^3/m^2 \cdot min$) is [0.11 ln(t)+0.02] or more, the average cooling rate at the central part of the plate thickness of the alloy material in the temperature range from 600 to 300° C. can be made 2.0° C./s or more, and consequently the coefficient of linear expansion can be kept low.

Thus, an increase in the coefficient of expansion caused by mixing in of impurities can be offset, and hence restrictions on the concentrations of impurity elements in the raw material can be relaxed. For example, each of C, Nb, Si, and Mn that is added in the alloy material of the present invention increases the coefficient of linear expansion of the alloy material. Cr, Cu, and Mo are elements for which there is a possibility that, when melting the alloy material, these elements may be mixed in from a front pot in which stainless steel is melted, and similarly these are elements that increase the coefficient of linear expansion of the alloy material. As a measure to suppress the mixing in of these elements, melting is performed with a new pot, but this leads to an increase in restrictions on opportunities for melting the alloy material and an increase in cost. Therefore, since the development of a magnetic phase can be suppressed by controlling the cooling rate at the central part of the plate thickness, it is possible to relax the restrictions on the concentrations of the alloying elements. Note that, whether or not the aforementioned heat treatment has been performed on an alloy material can be determined by whether or not the following formula is satisfied.

$$T_0 \leq T_1 - 2$$

Where, $T_0$ represents the Curie temperature (° C.) of the alloy material, and $T_1$ represents the Curie temperature (° C.) of the alloy material after the alloy material is held at 900° C. for one minute and thereafter is cooled under conditions such that the average cooling rate in the temperature range from 600 to 300° C. is 0.2° C./s.

Note that, an average cooling rate of 0.2° C./s corresponds to the cooling rate when an alloy material having a thickness of 80 mm is air-cooled.

The present invention has been made based on the above findings, and the gist of the present invention is an alloy material described hereunder.

An alloy material having a chemical composition consisting of, in mass %,

C: 0.010 to 0.10%,
Si: more than 0.10% and 0.50% or less,
Mn: 0.05 to 0.50%,
P: 0.015% or less,
S: 0.0015% or less,
Cr: 0,005 to 0.50%,
Ni: 34.5 to 37.0%,
Cu: 0.005 to 1.0%,
Co: 0.005 to 0.50%,
Mo: 0.001 to 0.50%,
Al: 0.0001 to 0.050%,
Nb: 0.001 to 1.0%,
N: 0.010% or less,
O: 0.0060% or less,
$T_1$: 0.0200% or less,
Zr: 0.0200% or less,
Hf: 0.0200% or less,
V: 0.500% or less,
W: 1.000% or less,
Sn: 0.050% or less,
Zn: 0.0020% or less,
Pb: 0.0010% or less,
Ta: 0 to 1.0%,
B: 0 to 0.010%,
Ca: 0 to 0.0050%,
Mg: 0 to 0.0030%,
REM: 0 to 0.050%, and
the balance: Fe and unavoidable impurities,
and satisfying Formula (1), Formula (2), Formula (3) and Formula (4) below,
wherein:
a yield stress is 240 MPa or more, and
a plate thickness is 3.0 mm or more;

$$T_0 \leq T_1 - 2 \quad (1)$$

$$C - Nb/7.7 - Ta/15 \leq 0.045 \quad (2)$$

$$Nb - 7.7C \leq 0.30 \quad (3)$$

$$Ta - 15C \leq 0.30 \quad (4)$$

where, each symbol of an element in the above formulas represents a content (mass %) of a corresponding element, $T_0$ represents a Curie temperature (° C.) of the alloy material, and $T_1$ represents a Curie temperature (° C.) of the alloy material after the alloy material is held at 900° C. for one minute and thereafter is cooled under conditions such that an average cooling rate in a temperature range from 600 to 300° C. is 0.2° C./s.

Advantageous Effects of Invention

According to the present invention, an alloy material that can increase the degree of freedom with respect to welding workability when producing a welded structure using the alloy material while maintaining low thermal expansion characteristics (specifically, the average coefficient of linear expansion from room temperature to −170° C. is $1.5\times10^{-6}$/K or less) and a method for producing the alloy material can be provided at a low cost.

DESCRIPTION OF EMBODIMENTS

Figure 1:
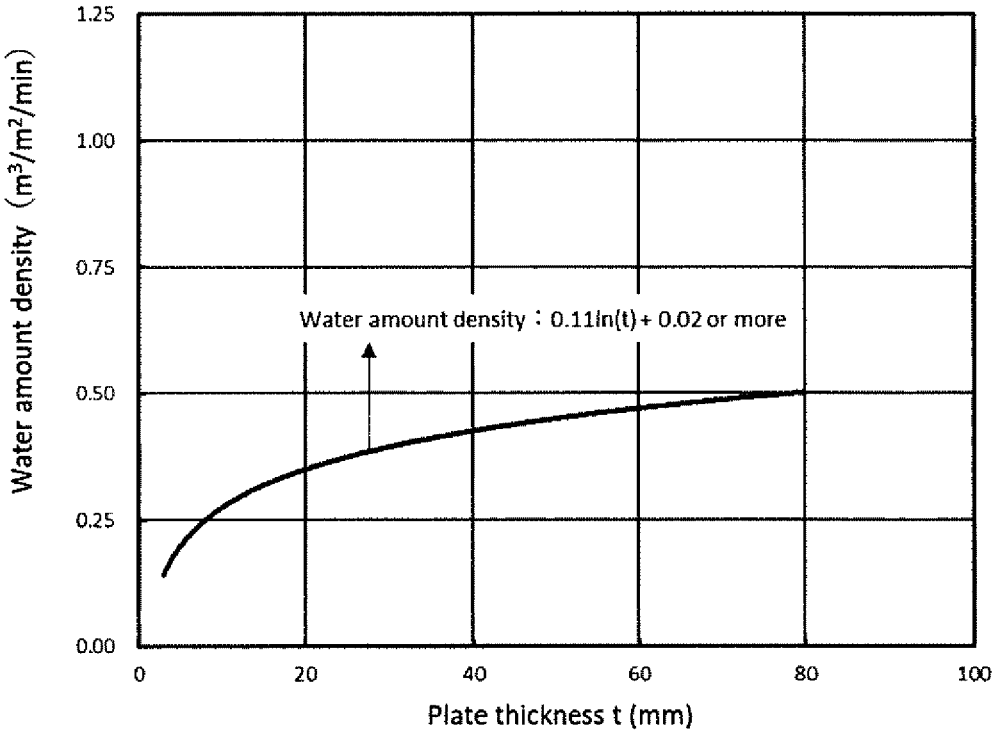
FIG. 1 is a view illustrating the relation between the plate thickness of a hot-rolled alloy plate and a water amount density ($m^3/m^2\cdot min$) for making a cooling rate at a central part of the plate thickness of the hot-rolled alloy plate 2.0° C./s or more.

Hereunder, the alloy material and the method for producing the alloy material of the present invention are described. In the following description, the symbol "%" with respect to the content of each element means "mass percent".

(Chemical Composition of Alloy Material)

C: 0.010 to 0.10%

C is effective for increasing the strength. Therefore, the content of C is set to 0.010% or more. The content of C is preferably set to 0.015% or more, and more preferably 0.020% or more. However, excessively containing C will deteriorate the hot workability and will adversely affect the thermal expansion characteristics. Therefore, the content of C is set to 0.10% or less. The content of C is preferably set to 0.08% or less, and more preferably 0.06% or less.

Si: more than 0.10% and 0.50% or less

Similarly to Mn to be described later, Si is an element that is necessary as a deoxidizer during alloy melting. Therefore, the content of Si is set to more than 0.10%. The content of Si is preferably set to 0.15% or more, and more preferably 0.20% or more. However, excessively containing Si will cause an adverse effect on the expansion characteristics. Therefore, the content of Si is set to 0.50% or less. The content of Si is preferably set to 0.40% or less, and more preferably 0.30% or less.

Mn: 0.05 to 0.50%

Similarly to Si that is described later, Mn is an element that is necessary as a deoxidizer during alloy melting. Further, Mn also has an effect of fixing S that deteriorates the hot workability, as MnS. Therefore, the content of Mn is set to 0.05% or more. The content of Mn is preferably set to 0.10% or more, and more preferably 0.15% or more. However, excessively containing Mn will cause an adverse effect on the expansion characteristics. Therefore, the content of Mn is set to 0.50% or less. The content of Mn is preferably set to 0.40% or less, and more preferably 0.30% or less.

P: 0.015% or less

P is an impurity element that significantly increases solidification cracking sensitivity and weld crack sensitivity. Therefore, the content of P is set to 0.015% or less. Whilst the content of P is preferably reduced as much as possible, extremely restricting the content of P will increase the production cost. Therefore, the content of P is preferably set to 0.001% or more.

S: 0.0015% or less

S is an impurity element that deteriorates the hot workability. Therefore, the content of S is set to 0.0015% or less. Whilst the content of S is preferably reduced as much as possible, extremely restricting the content of S will increase the production cost. Therefore, the content of S is preferably set to 0.0001% or more.

Cr: 0.005 to 0.50%

Cr is an element that is mixed in from equipment used to melt stainless steel or from raw materials, and causes an adverse effect on the thermal expansion characteristics. Therefore, the content of Cr is set to 0.50% or less. The content of Cr is preferably set to 0.40% or less. On the other hand, if it is attempted to excessively reduce Cr, the melting cost will increase. Therefore, the content of Cr is set to 0.005% or more.

Ni: 34.5 to 37.0%

Ni is an effective element for increasing the spontaneous volume magnetostriction of the alloy and lowering the coefficient of thermal expansion. Therefore, the content of Ni is set to 34.5% or more. The content of Ni is preferably set to 35.0% or more. However, if Ni is excessively contained, the production cost will increase. Therefore, the content of Ni is set to 37.0% or less.

Cu: 0,005 to 1.0%

Cu is an element that is mixed in from equipment used to melt stainless steel or from raw materials, and causes an adverse effect on the thermal expansion characteristics. Therefore, the content of Cu is set to 1.0% or less. The content of Cu is preferably set to 0.7% or less, and more preferably 0.5% or less. On the other hand, if it is attempted to excessively reduce Cu, the melting cost will increase. Therefore, the content of Cu is set to 0.005% or more.

Co: 0.005 to 0.50%

Co is an element that is mixed in from equipment used to melt stainless steel or from raw materials. Further, if Co is excessively contained, the alloy cost will increase. Therefore, the content of Co is set to 0.50% or less. The content of Co is preferably set to 0.40% or less, and more preferably 0.30% or less. On the other hand, if it is attempted to excessively reduce Co, the melting cost will increase. Therefore, the content of Co is set to 0.005% or more.

Mo: 0.001 to 0.50%

Mo is an element that is mixed in from equipment used to melt stainless steel or from raw materials, and causes an adverse effect on the thermal expansion characteristics. Therefore, the content of Mo is set to 0.50% or less. The content of Mo is preferably set to 0.40% or less, and more preferably 0.30% or less. On the other hand, if it is attempted to excessively reduce Mo, the melting cost will increase. Therefore, the content of Mo is set to 0.001% or more.

Al: 0.0001 to 0.050%

Al is an effective element for deoxidation. Therefore, the content of Al is set to 0.0001% or more. The content of Al is preferably set to 0.0003% or more, and more preferably 0.0005% or more. However, if Al is excessively contained, there will be an adverse effect on the thermal expansion characteristics. Therefore, the content of Al is set to 0.050% or less, and preferably is set to 0.040% or less.

Nb: 0.001 to 1.0%

Nb is an element that enhances strength, and also prevents cracking of the weld metal during welding and thereby improves the welding workability. Therefore, the content of Nb is set to 0.001% or more. The content of Nb is preferably set to 0.010% or more, and more preferably 0.015% or more. However, if Nb is excessively contained, the hot workability will decrease and there will be an adverse effect on the thermal expansion characteristics. Therefore, the content of Nb is set to 1.0% or less. The content of Nb is preferably set to 0.7% or less, and more preferably 0.5% or less.

N: 0.010% or less

N is an impurity element that deteriorates the hot workability. Therefore, the content of N is set to 0.010% or less. Whilst the content of N is preferably reduced as much as possible, extremely restricting N will cause the melting costs to increase. Therefore, the content of N is preferably set to 0.001% or more.

O: 0.0060% or less

O is an impurity element that exerts an adverse effect on the thermal expansion characteristics. Therefore, the content of O is set to 0.0060% or less. Whilst the content of O is preferably reduced as much as possible, extremely restricting O will cause the melting costs to increase. Therefore, the content of O is preferably set to 0.0005% or more.

$T_1$: 0.0200% or less

Zr: 0.0200% or less

Hf 0.0200% or less

V: 0.500% or less

W: 1.000% or less

Sn: 0.050% or less

Zn: 0.0020% or less

Pb: 0.0010% or less $T_1$, Zr, Hf, V, W, Sn, Zn and Pb are impurity elements that exert an adverse effect on the thermal expansion characteristics, and hence the contents of these elements are preferably low. Therefore, the content of $T_1$ is set to 0.0200% or less. The content of Zr is set to 0.0200% or less. The content of Hf is set to 0.0200% or less. The content of V is set to 0.500% or less. The content of W is set to 1.000% or less. The content of Sn is set to 0.050% or less. The content of Zn is set to 0.0020% or less. The content of Pb is set to 0.0010% or less. Note that, in some cases these elements are not contained.

Ta: 0 to 1.0%

Similarly to Nb, Ta is an element that enhances the strength, and also prevents cracking of the weld metal during welding and thereby improves the welding workability. Therefore, Ta may be contained as necessary. However, if Ta is excessively contained, the hot workability will decrease and there will be an adverse effect on the thermal expansion characteristics. Therefore, the content of Ta is set to 1.0% or less. On the other hand, to obtain the aforementioned effects, the content of Ta is preferably set to 0.01% or more.

B: 0 to 0.010%

B is an element that improves the hot workability, and therefore may be contained. However, if B is excessively contained, there will be an adverse effect on the thermal expansion characteristics. Therefore, the content of B is set to 0.010% or less. In a case where the contents of C and Nb are 0.04% or less and 0.15% or less, respectively, B need not be contained. On the other hand, to obtain the aforementioned effect, the content of B is preferably set to 0.0001% or more. The content of B is preferably set within the range of 0.0003 to 0.0030%.

Ca: 0 to 0.0050%

Mg: 0 to 0.0030%

REM: 0 to 0,050%

Ca, Mg and REM are each elements that improve the hot workability of the alloy material, and therefore may be contained. However, if these elements are excessively contained, on the contrary, in some cases these elements will cause the hot workability to decrease, and reduce the cleanliness of the alloy. Therefore, the content of Ca is set to 0.0050% or less. The content of Mg is set to 0.0030% or less. The content of REM is set to 0.050% or less. On the other hand, to obtain the aforementioned effect, the content of Ca is preferably set to 0.0005% or more. The content of Mg is preferably set to 0.0003% or more. The content of REM is preferably set to 0.001% or more.

It is necessary for the chemical composition of the alloy material to contain each element described above within the respectively defined ranges, and to satisfy the following Formula (2) and Formula (3). Further, when the chemical composition of the alloy material contains Ta, the chemical composition must also satisfy Formula (4). A compositional characteristic of the alloy material of the present invention is that the alloy material contains both of C and Nb, and NbC (Nb carbides) is formed in the alloy material. Since the coefficient of linear expansion of this alloy material increases with ΔC (=C—Nb/7.7-Ta/15) or ΔNb (=Nb-7.7C), the respective values of ΔC and ΔNb are restricted to an upper limit value or less. Ta is an element that belongs to the same group as Nb in the periodic table, and in the present alloy material Ta may be added in lieu of a part of Nb, and hence for the same reason it is important that the upper limit of ΔTa (=Ta-15C) is restricted.

$$\Delta C \leq 0.045 \quad (2)$$

$$\Delta Nb \leq 0.30 \quad (3)$$

$$\Delta Ta \leq 0.30 \quad (4)$$

Where, each symbol of an element in the above formulas represents the content (mass %) of the corresponding element.

The chemical composition of the alloy material contains the respective elements described above, with the balance being Fe and unavoidable impurities. The term "unavoidable impurities" means components which, during industrial production of the alloy, are mixed in due to various causes such as the raw material or the production equipment.

(Curie Temperature of Alloy Material)

It is necessary for the alloy material to satisfy the following Formula (1).

$$T_0 \leq T_1 - 2 \quad (1)$$

Where, $T_0$ represents the Curie temperature (° C.) of the alloy material, and $T_1$ represents the Curie temperature (° C.) of the alloy material after the alloy material is held at 900° C. for one minute and thereafter is cooled under conditions such that the average cooling rate in the temperature range from 600 to 300° C. is 0.2° C./s.

The above Formula (1) is an index which shows that, in the temperature range from 600 to 300° C., the alloy material was cooled under conditions such that the average cooling rate of the central part of the plate thickness of the alloy material was 2.0° C./s or more. That is, with the alloy material subjected to such a heat treatment, since an increase in the coefficient of expansion caused by mixing in of impurities can be offset, the coefficient of thermal expansion can be kept low while relaxing restrictions on the concentrations of impurity elements in the raw material.

Note that, with respect to measurement of $T_0$ and $T_1$, for example, measurement may be performed by the following procedure. Specifically, an alloy piece having dimensions of 3 mm in thickness×5 mm in width×1 mm in length is cut out from the hot-rolled alloy material by machining, and the surface is finished with wet-type emery #600 to remove the surface-processed layer to form a test specimen A.

Similarly, a test specimen having dimensions of 3 mm in thickness×8 mm in width×12 mm in length is cut out from the hot-rolled alloy material by machining, a thermocouple is welded to the surface, and a heat cycle is applied under conditions such that holding at 900° C. for 1 minute, and after cooling rate in a section from 600 to 300° C. is 0.2° C./s. A test specimen having dimensions of 3 mm in thickness×5 mm in width×1 mm in length is cut out by machining from the test specimen to which the heat cycle was applied, and the surface is polished using wet-type emery #600 to remove the surface-processed layer and thereby obtain a test specimen B.

Using the obtained test specimen A and test specimen B, the plate thickness direction of each test specimen is set to the magnetic field application direction and the longitudinal direction is set to the sample vibration direction by a vibrating sample magnetometer (VSM) that is capable of raising the specimen temperature, and temperature changes of magnetization are measured in a magnetic field of 40000 A/m (500 Ge). The rate of temperature increase is set to 3° C./min, and the temperature dependence of the magnetization of each sample is measured while increasing the temperature from room temperature to 300° C., and the temperature at which the magnetization disappears is extrapolated from a curve of the relative magnetization with respect to room temperature, and $T_0$ and $T_1$ are determined.

(Microstructure of Alloy Material)

The present alloy material contains C and Nb, and fine NbC precipitates in the alloy. Since coarse NbC may promote weld crack sensitivity due to eutectic melting, preferably the average diameter (equivalent circular diameter) of NbC that precipitates in the alloy material is 1 μm or less. Note that, in the present alloy material, dispersion of fine NbC has an effect of increasing the strength of the alloy plate. Therefore, the finer the NbC is, the more preferable it is. However, if the average diameter of NbC is less than 0.002 μm, an effect that increases the strength of the alloy plate will not be sufficiently obtained. Therefore, the average diameter of NbC is preferably 0.002 μm or more. The average diameter of NbC varies depending on the contents of Nb and C in the alloy, the cooling rate during casting, the heating temperature of hot rolling, the rolling temperature, the plate thickness and the subsequent cooling rate, and the rate of temperature increase, the holding temperature and the holding time in a heat treatment and the like, and in general the greater that the contents of C and Nb are, the lower that the heating temperature of hot rolling is, and the longer that the holding time in the heat treatment is, the larger that the average diameter tends to become. The average diameter of NbC can be measured by performing microstructure observation by an extraction replica method or with a transmission electron microscope using a thin film.

(Yield Stress)

In the present alloy material, the yield stress is made 240 MPa or more. If the yield strength is less than 240 MPa, sufficient strength as a welded structure will not be obtained, and it will be difficult to obtain a sufficient degree of freedom in welding. Therefore, the yield stress of the present alloy material is made 240 MPa or more. The yield stress is more preferably made 260 MPa or more. Note that, although an upper limit of the yield stress is not particularly limited, in the present alloy material, in most cases the yield stress is usually 450 MPa or less. Note that, yield stress in the present alloy material is 0.2% proof stress when a tensile test is performed in accordance with JIS Z 2241:2011.

(Plate Thickness)

In the present alloy material, the plate thickness is set to 3.0 mm or more. If the plate thickness is less than 3.0 mm, it will be difficult to obtain a sufficient degree of freedom in welding. Therefore, the plate thickness is set to 3.0 mm or more. The plate thickness is preferably set to 4.0 mm or more, and more preferably 6.0 mm or more. Note that, although an upper limit of the plate thickness is not particularly limited, in consideration of the welding workability, the upper limit is preferably set to 80 mm or less.

(Method for Producing Alloy Material)

With regard to a production method for obtaining the alloy material, preferably the alloy material is produced under the conditions described hereunder. The conditions for performing hot rolling are not particularly limited. An ingot obtained under normal melting conditions can be performed by rolling under normal hot rolling conditions. As the hot rolling conditions, for example, conditions can be mentioned in which after heating to 1050 to 1250° C. at which Nb and C dissolve, rolling is performed in a temperature range of 900 to 1100° C. which is the recrystallization temperature of the alloy material, or in a non-recrystallization temperature range from 900 to 700° C. The rolling reduction may be determined according to the target strength and other conditions.

However, the cooling conditions after hot rolling or the cooling conditions after heat treatment are important for achieving a low coefficient of thermal expansion. That is, in the temperature range from 600 to 300° C., it is necessary to perform cooling under conditions such that the average cooling rate of the central part of the plate thickness of the alloy material is 2.0° C./s or more. In the temperature range from 600 to 300° C., if the average cooling rate of the central part of the plate thickness of the alloy material is less than 2.0° C./s, unless the concentrations of impurity elements in the raw material are sufficiently restricted, it will not be possible to suppress the coefficient of thermal expansion to a low value.

In a cooling process in a heat treatment performed on the alloy material, when the plate thickness of the alloy material is represented by t (mm), it is necessary to eject cooling water onto the alloy material in a manner so that the water amount density ($m^3/m^2 \cdot min$) of the cooling water at a temperature of 35° C. or less is [0.11 ln(t)+0.02] or more. This is because the thickness of the alloy material that is the object of cooling is 3 to 80 mm, and unless cooling is performed with a sufficient water amount density, the aforementioned cooling rate cannot be realized.

Further, in the case of producing the alloy material by performing cooling after hot rolling and without performing a heat treatment, similarly, when the plate thickness of the alloy material is represented by t (mm), it is necessary to eject cooling water at a temperature of 35° C. or less onto the alloy material in a manner so that the water amount density ($m^3/m^2 \cdot min$) of the cooling water is [0.11 ln(t)+0.02] or more.

Note that, although basically the alloy material of the present invention is produced by performing water-cooling immediately after hot rolling, or is produced by, after hot rolling, performing a heat treatment of reheating and holding, there is no prohibition on adopting a method in which water-cooling is performed immediately after hot rolling, and thereafter a heat treatment of reheating and holding is performed. In the case of performing water-cooling both after hot rolling and after heat treatment, it suffices that at least the water-cooling after the heat treatment satisfies the aforementioned cooling conditions. Further, because the alloy material of the present invention is used for welded structures and the like, as mentioned above, it is necessary to increase the yield stress to 240 MPa or more. From this viewpoint, in the case or performing a heat treatment after hot rolling, preferably the holding temperature is set to 950° C. or less.

Thereafter, that is, after the cooling process after hot working, or after the cooling process in a heat treatment, leveler straightening may be performed to correct warping or the like of the alloy material. The leveler straightening is preferably performed within a range that does not significantly change the characteristics of the alloy material, and for example, the leveler straightening is preferably performed under conditions so that the increase in yield stress (0.2% proof stress) at ordinary temperature becomes a value that is 3 MPa or more and 50 MPa or less.

Example 1

Alloys having the chemical compositions shown in Tables 1 and 2 were melted using a vacuum furnace, and depending on the plate thickness of the final product (alloy material), 17-kg flat steel ingots having a wall thickness of 48 mm or 50-kg square steel ingots having a wall thickness of 110 mm were obtained.

For examples in which the plate thickness of the final product was to be 20 mm or less, the surface of the 17-kg flat steel ingot having a wall thickness of 48 mm was cut to obtain a rolling starting material having a thickness of 44 mm, and the rolling starting material was subjected to hot rolling to prepare a hot-rolled alloy plate having a thickness of 4 mm to 20 mm. On the other hand, for examples in which the plate thickness of the final product was to be 40 mm and examples in which the plate thickness was to be 80 mm, the 50-kg square steel ingot having a wall thickness of 110 mm was subjected to hot forging to obtain a rolling starting material having a plate thickness of 100 mm or a plate thickness of 160 mm, and these rolling starting materials were subjected to hot rolling to prepare hot-rolled alloy plates which had a plate thickness of 40 mm or a plate thickness of 80 mm. Some of the obtained hot-rolled alloy plates were allowed to cool temporarily to room temperature, and thereafter a heat treatment in which the hot-rolled alloy plates were held at various temperatures was performed, and the hot-rolled alloy plates were then cooled by water spraying under various conditions. Further, the remainder of the obtained hot-rolled alloy plates were cooled as they were by water spraying or the like.

For the examples for which a heat treatment was performed, a hole was formed from a side face of the hot-rolled alloy plate toward the center of the plate thickness, and the heat treatment was performed in a state in which a thermocouple was inserted into the hole, and thereafter the hot-rolled alloy plate was cooled to 300° C. or less while measuring the temperature at the central part of the plate thickness of the hot-rolled alloy plate. Note that, the water temperature of cooling water used for spray cooling was within the range of 20 to 25° C. With regard to the water amount density ejected onto the hot-rolled alloy plates, the cooling water amount was changed to various amounts by controlling the pressure of the cooling water supply device to thereby adjust the water amount density per unit time (min) and unit area.

FIG. 1 illustrates the relation between the plate thickness of a hot-rolled alloy plate and a water amount density ($m^3/m^2 \cdot min$) for making the cooling rate at the central part of the plate thickness of the hot-rolled alloy plate 2.0° C./s or more. As illustrated in FIG. 1, when the plate thickness of the hot-rolled alloy plate is represented by t (mm), in order to make the cooling rate at the central part of the plate thickness of the hot-rolled alloy plate 2.0° C./s or more it is necessary to eject cooling water at a temperature of 35° C. or less in a manner so that the water amount density ($m^3/m^2 \cdot min$) is [0.11 ln(t)+0.02] or more. Further, straightening was performed for some of the hot-rolled alloy materials. The various production conditions are shown in Table 3. Note that, the term "Plate Thickness" in Table 3 refers to the plate thickness of the hot-rolled alloy plate. Note that, a water amount density of 0.00 indicates that water-cooling was not performed.

TABLE 1

| Alloy | Chemical Composition (in mass %; balance is Fe and unavoidable impurities) | | | | | | | | | |
|---|---|---|---|---|---|---|---|---|---|---|
| Number | C | Si | Mn | P | S | Cr | Ni | Cu | Co | Mo |
| 1 | 0.031 | 0.19 | 0.26 | 0.005 | 0.0005 | 0.012 | 36.0 | 0.018 | 0.021 | 0.013 |
| 2 | 0.012 | 0.21 | 0.31 | 0.003 | 0.0004 | 0.032 | 36.0 | 0.006 | 0.025 | 0.008 |
| 3 | 0.028 | 0.18 | 0.30 | 0.006 | 0.0006 | 0.045 | 35.8 | 0.032 | 0.016 | 0.011 |
| 4 | 0.024 | 0.13 | 0.13 | 0.009 | 0.0008 | 0.12 | 35.7 | 0.28 | 0.15 | 0.17 |
| 5 | 0.027 | 0.18 | 0.25 | 0.007 | 0.0007 | 0.32 | 36.1 | 0.032 | 0.022 | 0.008 |
| 6 | 0.029 | 0.16 | 0.28 | 0.005 | 0.0003 | 0.011 | 35.7 | 0.023 | 0.017 | 0.012 |
| 7 | 0.023 | 0.26 | 0.08 | 0.006 | 0.0004 | 0.018 | 35.4 | 0.025 | 0.38 | 0.021 |
| 8 | 0.031 | 0.15 | 0.29 | 0.005 | 0.0003 | 0.024 | 36.2 | 0.022 | 0.21 | 0.23 |
| 9 | 0.032 | 0.15 | 0.28 | 0.005 | 0.0004 | 0.023 | 36.2 | 0.023 | 0.22 | 0.023 |
| 10 | 0.053 | 0.14 | 0.29 | 0.005 | 0.0003 | 0.025 | 36.2 | 0.024 | 0.21 | 0.15 |
| 11 | 0.065 | 0.16 | 0.12 | 0.006 | 0.0008 | 0.013 | 36.0 | 0.007 | 0.14 | 0.018 |
| 12 | 0.028 | 0.16 | 0.26 | 0.006 | 0.0007 | 0.14 | 36.0 | 0.024 | 0.13 | 0.009 |
| 13 | 0.029 | 0.17 | 0.27 | 0.005 | 0.0008 | 0.009 | 35.9 | 0.032 | 0.12 | 0.010 |
| 14 | 0.12 | 0.18 | 0.26 | 0.007 | 0.0004 | 0.004 | 36.0 | 0.004 | 0.003 | <0.001 |
| 15 | 0.031 | 0.18 | 0.26 | 0.006 | 0.0005 | 0.022 | 36.0 | 0.022 | 0.018 | 0.005 |
| 16 | 0.021 | 0.12 | 0.27 | 0.005 | 0.0005 | 0.003 | 36.1 | 0.019 | 0.022 | 0.012 |
| 17 | 0.011 | 0.19 | 0.25 | 0.005 | 0.0007 | 0.019 | 35.9 | 0.003 | 0.019 | <0.001 |
| 18 | 0.013 | 0.18 | 0.26 | 0.004 | 0.0005 | 0.020 | 35.8 | 0.002 | 0.020 | 0.013 |
| 19 | 0.008 | 0.03 | 0.21 | 0.004 | 0.0005 | 0.008 | 35.9 | 0.006 | 0.025 | 0.005 |

| Alloy | Chemical Composition (in mass %; balance is Fe and unavoidable impurities) | | | | | | |
|---|---|---|---|---|---|---|---|
| Number | Al | Nb | Ta | B | Ca | Mg | REM |
| 1 | 0.0006 | 0.001 | <0.001 | <0.0001 | <0.0001 | <0.0001 | <0.001 |
| 2 | 0.0009 | 0.024 | <0.001 | 0.0002 | <0.0001 | <0.0001 | <0.001 |
| 3 | 0.0008 | 0.122 | 0.52 | 0.0012 | <0.0001 | <0.0001 | <0.001 |
| 4 | 0.035 | 0.31 | 0.015 | 0.0013 | <0.0001 | <0.0001 | <0.001 |
| 5 | 0.0014 | 0.48 | <0.001 | 0.0025 | <0.0001 | <0.0001 | <0.001 |
| 6 | 0.0012 | 0.015 | <0.001 | 0.0021 | <0.0001 | <0.0001 | <0.001 |
| 7 | 0.0021 | 0.018 | <0.001 | <0.0001 | <0.0001 | <0.0001 | <0.001 |
| 8 | 0.0016 | 0.015 | <0.001 | 0.0001 | 0.0003 | 0.0003 | <0.001 |
| 9 | 0.032 | 0.016 | <0.001 | 0.0012 | 0.0021 | <0.0001 | 0.021 |
| 10 | 0.0035 | 0.29 | 0.12 | 0.0024 | 0.0005 | 0.0012 | <0.001 |
| 11 | 0.023 | 0.53 | <0.001 | 0.0025 | <0.0001 | <0.0001 | <0.001 |
| 12 | 0.0013 | 0.019 | <0.001 | 0.0008 | 0.0017 | <0.0001 | <0.001 |
| 13 | 0.0014 | 0.022 | <0.001 | 0.0006 | <0.0001 | <0.0001 | 0.018 |
| 14 | 0.0012 | <0.001 | <0.001 | <0.0001 | <0.0001 | <0.0001 | <0.001 |
| 15 | 0.023 | 1.20 | <0.001 | 0.0002 | <0.0001 | <0.0001 | <0.001 |
| 16 | 0.0013 | <0.001 | <0.001 | 0.013 | <0.0001 | <0.0001 | <0.001 |
| 17 | 0.033 | 0.43 | <0.001 | <0.0001 | <0.0001 | <0.0001 | <0.001 |
| 18 | 0.028 | 0.001 | 0.63 | <0.0001 | <0.0001 | <0.0001 | <0.001 |
| 19 | 0.0004 | 0.001 | <0.001 | <0.0001 | <0.0001 | <0.0001 | <0.001 |

An underline indicates deviation from the range defined by the present invention, or deviation from a desired characteristic value.

TABLE 2

| Alloy | Chemical Composition (in mass %; balance is Fe and unavoidable impurities) | | | | | | | | | | | | | Reduction of |
|---|---|---|---|---|---|---|---|---|---|---|---|---|---|---|
| Number | N | O | Ti | Zr | Hf | V | W | Sn | Zn | Pb | ΔC | ΔNb | Δta | Area (%) |
| 1 | 0.0025 | 0.0012 | <0.0001 | <0.0001 | <0.0001 | <0.001 | <0.001 | <0.001 | <0.0001 | <0.0001 | 0.031 | −0.24 | — | 80 |
| 2 | 0.0023 | 0.0031 | <0.0001 | <0.0001 | <0.0001 | <0.001 | <0.001 | <0.001 | <0.0001 | <0.0001 | 0.009 | −0.07 | — | 78 |
| 3 | 0.0025 | 0.0039 | <0.0001 | <0.0001 | <0.0001 | <0.001 | <0.001 | <0.001 | <0.0001 | <0.0001 | 0.012 | −0.09 | 0.10 | 65 |
| 4 | 0.0011 | 0.0021 | <0.0001 | <0.0001 | <0.0001 | <0.001 | <0.001 | <0.001 | <0.0001 | <0.0001 | −0.016 | 0.13 | −0.35 | 68 |
| 5 | 0.0008 | 0.0023 | <0.0001 | 0.0005 | <0.0001 | <0.001 | <0.001 | <0.001 | <0.0001 | <0.0001 | −0.035 | 0.27 | — | 71 |
| 6 | 0.0023 | 0.0015 | 0.0003 | <0.0001 | <0.0001 | 0.008 | <0.001 | <0.001 | <0.0001 | <0.0001 | 0.027 | −0.21 | — | 82 |
| 7 | 0.0013 | 0.0008 | <0.0001 | <0.0001 | 0.0012 | <0.001 | 0.013 | <0.001 | <0.0001 | <0.0001 | 0.021 | −0.16 | — | 70 |
| 8 | 0.0023 | 0.0028 | <0.0001 | <0.0001 | <0.0001 | <0.001 | <0.001 | <0.001 | <0.0001 | <0.0001 | 0.029 | −0.22 | — | 72 |
| 9 | 0.0025 | 0.0013 | <0.0001 | <0.0001 | <0.0001 | <0.001 | <0.001 | <0.001 | <0.0001 | <0.0001 | 0.030 | −0.23 | — | 76 |
| 10 | 0.0063 | 0.0023 | <0.0001 | <0.0001 | <0.0001 | 0.013 | <0.001 | <0.001 | <0.0001 | <0.0001 | 0.015 | −0.12 | −0.68 | 75 |
| 11 | 0.0026 | 0.0024 | <0.0001 | 0.0006 | <0.0001 | <0.001 | <0.001 | 0.003 | <0.0001 | <0.0001 | −0.004 | 0.03 | — | 64 |
| 12 | 0.0013 | 0.0013 | 0.0015 | <0.0001 | <0.0001 | 0.014 | 0.015 | <0.001 | 0.0008 | <0.0001 | 0.026 | −0.20 | — | 73 |
| 13 | 0.0008 | 0.0012 | <0.0001 | <0.0001 | <0.0001 | <0.001 | <0.001 | <0.001 | <0.0001 | 0.0002 | 0.026 | −0.20 | — | 74 |
| 14 | 0.0028 | 0.0032 | <0.0001 | <0.0001 | <0.0001 | <0.001 | <0.001 | <0.001 | <0.0001 | <0.0001 | 0.120 | 0.00 | — | 54 |
| 15 | 0.0027 | 0.0013 | <0.0001 | <0.0001 | <0.0001 | <0.001 | <0.001 | <0.001 | <0.0001 | <0.0001 | −0.125 | 0.96 | — | 52 |
| 16 | 0.0026 | 0.0024 | <0.0001 | <0.0001 | <0.0001 | <0.001 | <0.001 | <0.001 | <0.0001 | <0.0001 | 0.021 | −0.16 | — | 73 |

TABLE 2-continued

| Alloy | Chemical Composition (in mass %; balance is Fe and unavoidable impurities) | | | | | | | | | | | | | Reduction of |
|---|---|---|---|---|---|---|---|---|---|---|---|---|---|---|
| Number | N | O | Ti | Zr | Hf | V | W | Sn | Zn | Pb | ΔC | ΔNb | Δta | Area (%) |
| 17 | 0.0029 | 0.0014 | <0.0001 | <0.0001 | <0.0001 | <0.001 | <0.001 | <0.001 | <0.0001 | <0.0001 | −0.045 | 0.35 | — | 42 |
| 18 | 0.0024 | 0.0012 | <0.0001 | <0.0001 | <0.0001 | <0.001 | <0.001 | <0.001 | <0.0001 | <0.0001 | 0.013 | −0.10 | 0.44 | 43 |
| 19 | 0.0014 | 0.0013 | <0.0001 | <0.0001 | <0.0001 | <0.001 | <0.001 | <0.001 | <0.0001 | <0.0001 | 0.008 | −0.06 | — | 80 |

An underline indicates deviation from the range defined by the present invention, or that the desired performance is not satisfied.

TABLE 3

| | | | Hot Rolling | | | Heat Treatment | | | | Straightening | |
|---|---|---|---|---|---|---|---|---|---|---|---|
| | No. | Alloy Number | End Temperature (° C.) | Plate Thickness t (mm) | Water Amount Density ($m^3/m^2 \cdot min$) | Holding Temperature (° C.) | Water Amount Density ($m^3/m^2 \cdot min$) | [1] | Cooling Rate (° C./s) | Yes/No | Yield Stress Increase (MPa) |
| Inventive Example of Present Invention | 1 | 1 | 700 | 4 | — | 830 | 0.25 | 0.17 | 132 | No | 0 |
| | 2 | 1 | 800 | 6 | — | 830 | 0.30 | 0.22 | 98 | No | 0 |
| | 3 | 1 | 850 | 10 | — | 830 | 0.75 | 0.27 | 52 | No | 0 |
| | 4 | 1 | 850 | 20 | — | 830 | 0.75 | 0.35 | 20 | No | 0 |
| | 5 | 1 | 900 | 40 | — | 830 | 0.75 | 0.43 | 8 | No | 0 |
| | 6 | 1 | 900 | 80 | — | 830 | 0.60 | 0.50 | 3 | No | 0 |
| | 7 | 1 | 900 | 80 | — | 830 | 0.50 | 0.50 | 2 | No | 0 |
| | 8 | 1 | 850 | 10 | — | 830 | 0.75 | 0.27 | 53 | Yes | 25 |
| | 9 | 1 | 800 | 10 | — | 760 | 0.75 | 0.27 | 50 | Yes | 25 |
| | 10 | 2 | 850 | 10 | — | 830 | 0.75 | 0.27 | 50 | No | 0 |
| | 11 | 3 | 900 | 10 | — | 950 | 0.75 | 0.27 | 49 | No | 0 |
| | 12 | 4 | 900 | 10 | — | 900 | 0.75 | 0.27 | 48 | No | 0 |
| | 13 | 5 | 900 | 10 | — | 950 | 0.75 | 0.27 | 45 | No | 0 |
| | 14 | 6 | 850 | 10 | — | 830 | 0.75 | 0.27 | 49 | No | 0 |
| | 15 | 7 | 850 | 10 | — | 830 | 0.75 | 0.27 | 50 | No | 0 |
| | 16 | 8 | 800 | 6 | — | 830 | 0.30 | 0.22 | 94 | Yes | 20 |
| | 17 | 8 | 850 | 10 | — | 830 | 0.50 | 0.27 | 47 | Yes | 20 |
| | 18 | 8 | 850 | 20 | — | 830 | 0.50 | 0.35 | 18 | Yes | 20 |
| | 19 | 8 | 900 | 40 | — | 830 | 0.50 | 0.43 | 7 | Yes | 20 |
| | 20 | 8 | 900 | 80 | — | 830 | 0.60 | 0.50 | 3 | Yes | 20 |
| | 21 | 9 | 850 | 10 | — | 830 | 0.50 | 0.27 | 50 | No | 0 |
| | 22 | 10 | 850 | 10 | — | 900 | 0.50 | 0.27 | 49 | No | 0 |
| | 23 | 11 | 850 | 10 | — | 950 | 0.50 | 0.27 | 47 | No | 0 |
| | 24 | 12 | 850 | 10 | — | 830 | 0.50 | 0.27 | 49 | No | 0 |
| | 25 | 13 | 850 | 10 | — | 830 | 0.50 | 0.27 | 48 | No | 0 |
| | 26 | 1 | 800 | 10 | 0.35 | — | | 0.27 | — | Yes | 10 |
| | 27 | 1 | 850 | 10 | 0.50 | — | | 0.27 | — | Yes | 15 |
| | 28 | 1 | 900 | 10 | 0.50 | — | | 0.27 | — | Yes | 20 |
| | 29 | 2 | 900 | 10 | 0.35 | — | | 0.27 | — | Yes | 25 |
| | 30 | 3 | 950 | 20 | 0.50 | — | | 0.35 | — | Yes | 25 |
| | 31 | 4 | 950 | 10 | 0.50 | — | | 0.27 | — | Yes | 25 |
| | 32 | 5 | 950 | 10 | 0.50 | — | | 0.27 | — | Yes | 25 |
| | 33 | 6 | 900 | 10 | 0.35 | — | | 0.27 | — | Yes | 30 |
| | 34 | 7 | 900 | 10 | 0.50 | — | | 0.27 | — | Yes | 30 |
| | 35 | 8 | 800 | 10 | 0.50 | — | | 0.27 | — | Yes | 10 |
| | 36 | 8 | 850 | 20 | 0.50 | — | | 0.35 | — | Yes | 15 |
| | 37 | 8 | 900 | 40 | 0.75 | — | | 0.43 | — | Yes | 20 |
| Comparative Example | 38 | 14 | 850 | 10 | — | 830 | 0.30 | 0.27 | 40 | No | 0 |
| | 39 | 15 | 900 | 40 | — | 950 | 0.50 | 0.43 | 7 | No | 0 |
| | 40 | 16 | 850 | 10 | — | 830 | 0.50 | 0.27 | 47 | No | 0 |
| | 41 | 17 | 900 | 40 | — | 950 | 0.00 | 0.43 | <1 | No | 0 |
| | 42 | 18 | 850 | 10 | — | 950 | 0.50 | 0.27 | 46 | No | 0 |
| | 43 | 1 | 900 | 40 | — | 830 | 0.00 | 0.43 | <1 | No | 0 |
| | 44 | 1 | 900 | 40 | — | 830 | 0.05 | 0.43 | 1 | No | 0 |
| | 45 | 1 | 900 | 80 | — | 830 | 0.10 | 0.50 | 1 | No | 0 |
| | 46 | 8 | 900 | 40 | — | 830 | 0.00 | 0.43 | <1 | No | 0 |
| | 47 | 8 | 900 | 40 | — | 830 | 0.05 | 0.43 | 1 | No | 0 |
| | 48 | 8 | 900 | 80 | — | 830 | 0.10 | 0.50 | 1 | No | 0 |
| | 49 | 1 | 850 | 10 | 0.00 | — | | 0.27 | — | Yes | 15 |
| | 50 | 2 | 850 | 10 | 0.00 | — | | 0.27 | — | Yes | 15 |
| | 51 | 19 | 850 | 20 | 0.50 | 900 | 0.50 | 0.35 | — | No | 0 |
| | 52 | 1 | 850 | 10 | — | 1000 | 0.50 | 0.27 | — | No | 0 |

An underline indicates deviation from the range of the present invention, deviation from recommended production conditions, or that the desired performance is not satisfied.

[1] denotes calculated value of [0.11 In(t) + 0.02]

Results obtained by conducting various tests described hereunder on the obtained ingots and hot-rolled alloy materials are shown in Table 4. Note that, with respect to the obtained alloy materials of 3, 10, 13 and 23 that were each an inventive example of the present invention, when the average diameter of NbC was measured, the average diameter was 1 μm or less in each of these alloy materials.

(Reduction of Area)

A smooth high-temperature tensile test specimen of 8 mmφ×110 mmL was taken from a near-surface portion of the 17-kg flat steel ingots having a wall thickness of 48 mm or the 50-kg square steel ingots having a wall thickness of 110 mm. A 14 mmL portion at the center part of the test specimen was heated at 1180° C. for 30 seconds by high-frequency heating, and after lowering the temperature to 900° C. and holding at that temperature for 10 seconds, tensile rupture was made to occur at a speed of 20 mm/s, and the contraction of area: reduction of area (%) was measured. The results are shown in Table 1. A case where the reduction of area satisfied the condition of being 60% or more was evaluated as "Good".

(Measurement of Curie Temperature)

An alloy piece having dimensions of 3 mm in thickness×5 mm in width×1 mm in length was cut out from the obtained hot-rolled alloy materials, and the surface was finished with wet-type emery #600 to remove the surface-processed layer and form a test specimen A.

On the other hand, a test specimen having dimensions of 3 mm in thickness×8 mm in width×12 mm in length was cut out from the obtained hot-rolled alloy materials by machining, a thermocouple was welded to the surface, and a heat cycle was applied under conditions such that holding at 900° C. for 1 minute, and after cooling rate in a section from 600 to 300° C. is 0.2° C./s. A test specimen having dimensions of 3 mm in thickness×5 mm in width×1 mm in length was cut out by machining from the test specimen to which the heat cycle was applied, and the surface was polished using wet-type emery #600 to remove the surface-processed layer and obtain a test specimen B.

Using the obtained test specimen A and test specimen B, the plate thickness direction of each test specimen was set to the magnetic field application direction and the longitudinal direction was set to the sample vibration direction by a vibrating sample magnetometer (VSM) capable of raising the specimen temperature, and a temperature change of magnetization was measured in a magnetic field of 40000 A/m (500 Oe). The rate of temperature increase was set to 3° C./min, and the temperature dependence of the magnetization of each sample was measured while increasing the temperature from room temperature to 300° C., and the Curie temperatures $T_0$ and $T_1$ were determined based on the temperature at which the magnetization disappeared. Note that, $T_0$ represents the Curie temperature (° C.) of each of the various kinds of alloy materials, and $T_1$ represents the Curie temperature (° C.) of each of the various kinds of alloy materials after the respective alloy materials were held at 900° C. for 1 minute and thereafter cooled under conditions such that the average cooling rate at the central part of the plate thickness of the alloy material in the temperature range from 600 to 300° C. was 0.2° C./s.

Figure 2:
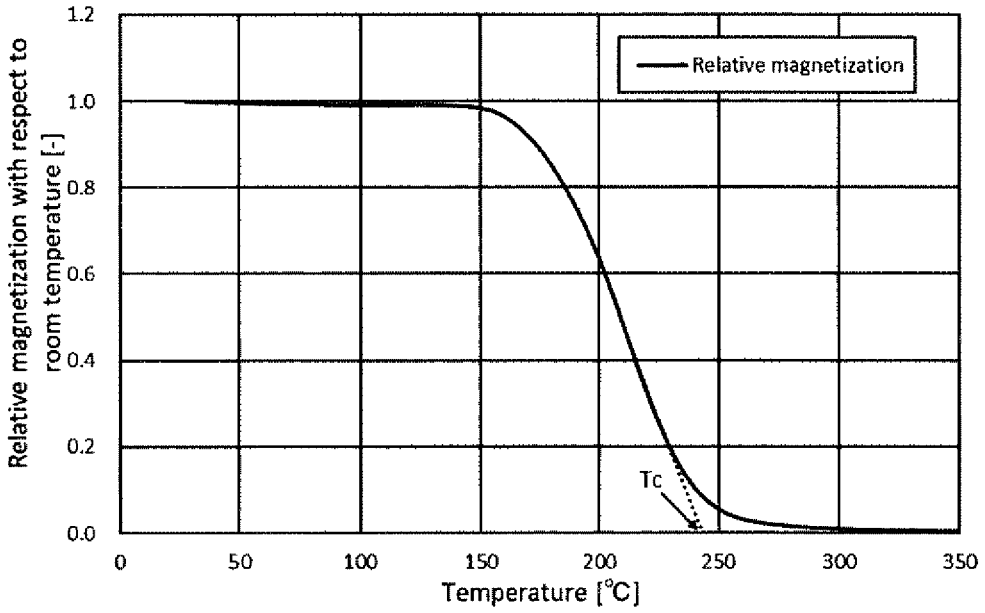
FIG. 2 is a view illustrating a temperature change of magnetization in an alloy material of an alloy number 1.

FIG. 2 is a view illustrating a temperature change of magnetization (relative magnetization with respect to room temperature and inverse of magnetization) in the alloy material of alloy number 1. As illustrated in FIG. 2, the Curie temperatures $T_0$ and $T_1$ were determined by extrapolating the temperature at which the magnetization disappears from a curve of the relative magnetization with respect to room temperature. That is, in this example, based on the point of intersection between an extension line of a portion that linearly decreases with increasing temperature and a straight line representing that the relative magnetization with respect to room temperature is zero, the Curie temperature (described as "Tc" in FIG. 2) was taken as 244° C. Table 2 shows the Curie temperatures $T_0$ and $T_1$ and the difference between these temperatures.

(Mechanical Strength)

A tensile test was conducted in the atmosphere at ordinary temperature (20° C.±15° C.) in accordance with JIS Z 2241: 2011, and the tensile strength TS (MPa) and yield stress YS (MPa) were determined. Test specimens in which the YS was 240 MPa or more were evaluated as "Good". Note that, the yield stress was 0.2% proof stress.

(Coefficient of Thermal Expansion)

A test specimen having a shape of 3 mm in diameter×15 mm in length was taken from the central part of the plate thickness of the obtained hot-rolled alloy plate, and the average coefficient of linear expansion from room temperature to −170° C. was determined using a push-rod type thermal dilatometer. Test specimens having an average coefficient of linear expansion of $1.5\times10^{-6}$/K or less were evaluated as "Good".

TABLE 4

| | | | Performance Evaluation | | | | |
|---|---|---|---|---|---|---|---|
| | No. | Alloy Number | 0.2% Proof Stress (MPa) | T0 (° C.) | T1 (° C.) | T1 − T0 (° C.) | Coefficient of Linear Expansion ($\times10^{-6}$/K) |
| Inventive Examples of Present Invention | 1 | 1 | 273 | 219 | 244 | 25 | 1.0 |
| | 2 | 1 | 265 | 220 | 244 | 24 | 1.1 |
| | 3 | 1 | 262 | 221 | 244 | 23 | 1.2 |
| | 4 | 1 | 251 | 226 | 244 | 18 | 1.2 |
| | 5 | 1 | 247 | 230 | 244 | 14 | 1.2 |
| | 6 | 1 | 245 | 235 | 244 | 9 | 1.2 |
| | 7 | 1 | 244 | 240 | 244 | 4 | 1.3 |
| | 8 | 1 | 289 | 220 | 244 | 24 | 1.2 |
| | 9 | 1 | 308 | 221 | 244 | 23 | 1.2 |
| | 10 | 2 | 267 | 220 | 240 | 20 | 1.2 |
| | 11 | 3 | 334 | 212 | 230 | 18 | 1.4 |
| | 12 | 4 | 346 | 216 | 235 | 19 | 1.3 |
| | 13 | 5 | 385 | 214 | 231 | 17 | 1.4 |
| | 14 | 6 | 288 | 220 | 241 | 21 | 1.2 |
| | 15 | 7 | 287 | 220 | 239 | 19 | 1.2 |
| | 16 | 8 | 372 | 213 | 238 | 25 | 1.2 |
| | 17 | 8 | 361 | 214 | 238 | 24 | 1.2 |
| | 18 | 8 | 355 | 219 | 238 | 19 | 1.2 |
| | 19 | 8 | 351 | 225 | 238 | 13 | 1.3 |
| | 20 | 8 | 344 | 230 | 238 | 8 | 1.4 |
| | 21 | 9 | 294 | 216 | 240 | 24 | 1.2 |
| | 22 | 10 | 352 | 212 | 234 | 22 | 1.3 |
| | 23 | 11 | 403 | 211 | 228 | 17 | 1.5 |
| | 24 | 12 | 287 | 218 | 240 | 22 | 1.2 |
| | 25 | 13 | 290 | 219 | 240 | 21 | 1.2 |
| | 26 | 1 | 372 | 225 | 244 | 19 | 1.2 |
| | 27 | 1 | 360 | 224 | 244 | 20 | 1.2 |
| | 28 | 1 | 362 | 223 | 244 | 21 | 1.2 |
| | 29 | 2 | 365 | 223 | 240 | 17 | 1.2 |
| | 30 | 3 | 398 | 213 | 230 | 17 | 1.4 |
| | 31 | 4 | 424 | 218 | 235 | 17 | 1.3 |
| | 32 | 5 | 430 | 217 | 231 | 14 | 1.4 |
| | 33 | 6 | 383 | 223 | 241 | 18 | 1.2 |
| | 34 | 7 | 384 | 222 | 239 | 17 | 1.2 |
| | 35 | 8 | 401 | 218 | 238 | 20 | 1.2 |
| | 36 | 8 | 391 | 217 | 238 | 21 | 1.2 |
| | 37 | 8 | 372 | 216 | 238 | 22 | 1.2 |
| Comparative Example | 38 | 14 | 374 | 219 | 235 | 16 | 1.6 |
| | 39 | 15 | 415 | 233 | 236 | 10 | 1.8 |
| | 40 | 16 | 225 | 222 | 238 | 16 | 1.7 |
| | 41 | 17 | 352 | 237 | 238 | 1 | 1.6 |
| | 42 | 18 | 364 | 218 | 235 | 17 | 1.6 |

TABLE 4-continued

| No. | Alloy Number | Performance Evaluation 0.2% Proof Stress (MPa) | T0 (° C.) | T1 (° C.) | T1 − T0 (° C.) | Coefficient of Linear Expansion ($\times 10^{-6}$/K) |
|---|---|---|---|---|---|---|
| 43 | 1 | 247 | 243 | 244 | 1 | 1.6 |
| 44 | 1 | 247 | 243 | 244 | 1 | 1.6 |
| 45 | 1 | 245 | 243 | 244 | 1 | 1.6 |
| 46 | 8 | 331 | 237 | 238 | 1 | 1.7 |
| 47 | 8 | 331 | 237 | 238 | 1 | 1.7 |
| 48 | 8 | 329 | 237 | 238 | 1 | 1.7 |
| 49 | 1 | 365 | 243 | 244 | 1 | 1.6 |
| 50 | 2 | 358 | 239 | 240 | 1 | 1.6 |
| 51 | 19 | 223 | 223 | 242 | 19 | 1.2 |
| 52 | 1 | 215 | 225 | 244 | 19 | 1.3 |

An underline indicates deviation from the range of the present invention, deviation from recommended production conditions, or that the desired performance is not satisfied.

As shown in Table 4, Examples 1 to 37 which satisfied all the conditions of the present invention were evaluated as "Good" with respect to each of reduction of area, strength, and coefficient of linear expansion. In contrast, Examples 38 to 52 which did not satisfy conditions of the present invention were poor with respect to at least performance regarding the coefficient of linear expansion.

INDUSTRIAL APPLICABILITY

According to the present invention, an alloy material that can increase the degree of freedom with respect to welding workability when producing a welded structure using the alloy material while maintaining low thermal expansion characteristics, and a method for producing the alloy material can be provided at a low cost. The alloy material of the present invention, for example, can suppress deformation caused by a temperature change from room temperature to a cryogenic temperature in a structure in a cryogenic environment or the like, and can also improve welding workability when produced as piping or as a structure.

The invention claimed is:

1. An alloy material having a chemical composition consisting of, in mass %, C: 0.010 to 0.10%,
Si: more than 0.10% to 0.50% or less,
Mn: 0.05 to 0.50%,
P: 0.015% or less,
S: 0.0015% or less,
Cr: 0.005 to 0.50%,
Ni: 34.5 to 37.0%,
Cu: 0.005 to 1.0%,
Co: 0.005 to 0.50%,
Mo: 0.001 to 0.50%,
Al: 0.0001 to 0.050%,
Nb: 0.001 to 1.0%,
N: 0.010% or less,
O: 0.0060% or less,
Ti: 0.0200% or less,
Zr: 0.0200% or less,
Hf: 0.0200% or less,
V: 0.500% or less,
W: 1.000% or less,
Sn: 0.050% or less,
Zn: 0.0020% or less,
Pb: 0.0010% or less,
Ta: 0 to 1.0%,
B: 0 to 0.010%,
Ca: 0 to 0.0050%,
Mg: 0 to 0.0030%,
REM: 0 to 0.050%, and
the balance: Fe and unavoidable impurities,
and satisfying Formula (1), Formula (2), Formula (3) and Formula (4) below,
wherein:
a yield stress is 240 MPa or more, and
a plate thickness is 3.0 mm or more;

$$T_0 \leq T_1 - 2 \quad (1)$$

$$C - Nb/7.7 - Ta/15 \leq 0.045 \quad (2)$$

$$Nb - 7.7C \leq 0.30 \quad (3)$$

$$Ta - 15C \leq 0.30 \quad (4)$$

where, each symbol of an element in the above formulas represents a content, in mass %, of a corresponding element, $T_0$ represents a Curie temperature, in ° C., of the alloy material, and $T_1$ represents a Curie temperature, in ° C., of the alloy material after the alloy material is held at 900° C. for one minute and thereafter is cooled under conditions such that an average cooling rate in a temperature range from 600 to 300° C. is 0.2° C./s.

2. A method for producing the alloy material according to claim 1, comprising:

a heat treatment performed on the alloy material including a cooling process, wherein the cooling process ejects water at a temperature of 35° C. or less onto the alloy material in a manner so that a water amount density, in $m^3/m^2 \cdot min$, of the water is [0.11 ln(t)+0.02] or more, where a plate thickness of the alloy material is represented by t, in mm.

3. A method for producing the alloy material according to claim 1, comprising:

a hot working of the alloy material including a cooling process, wherein the cooling process ejects water at a temperature of 35° C. or less onto the alloy material in a manner so that a water amount density, in $m^3/m^2 \cdot min$, of the water is [0.11 ln(t)+0.02] or more, where a plate thickness of the alloy material is represented by t, in mm.

4. The method according to claim 2, wherein:

after the cooling process, leveler straightening is performed under conditions so that an increase in yield stress measured at 20° C.±15° C. in accordance with JIS Z 2241:2011 is a value that is 3 MPa or more and 50 MPa or less.

5. The method according to claim 3, wherein:

after the cooling process, leveler straightening is performed under conditions so that an increase in yield stress measured at 20° C.±15° C. in accordance with JIS Z 2241:2011 is a value that is 3 MPa or more and 50 MPa or less.

* * * * *